US009952021B2

(12) United States Patent
Ferguson

(10) Patent No.: US 9,952,021 B2
(45) Date of Patent: Apr. 24, 2018

(54) ANTI-BALLISTIC BARRIER FOR HIGH VALUE FACILITIES PROTECTION SUCH AS ELECTRICAL GRID EQUIPMENT

(71) Applicant: Frontline Ballistic Barriers, LLC, Demorest, GA (US)

(72) Inventor: Jeffery Eugene Ferguson, Clarksville, GA (US)

(73) Assignee: FRONTLINE BALLISTIC BARRIERS, LLC, Demorest, GA (US)

( * ) Notice: Subject to any disclaimer, the term of this patent is extended or adjusted under 35 U.S.C. 154(b) by 0 days.

(21) Appl. No.: 15/223,029

(22) Filed: Jul. 29, 2016

(65) Prior Publication Data

US 2017/0030689 A1 Feb. 2, 2017

Related U.S. Application Data

(60) Provisional application No. 62/198,424, filed on Jul. 29, 2015.

(51) Int. Cl.

| | |
|---|---|
| ***F41H 5/24*** | (2006.01) |
| ***F41H 5/013*** | (2006.01) |
| ***E04H 9/04*** | (2006.01) |
| *E04F 10/08* | (2006.01) |

(52) U.S. Cl.

CPC ..... *F41H 5/24* (2013.01); *E04H 9/04* (2013.01); *F41H 5/013* (2013.01); *E04F 10/08* (2013.01)

(58) Field of Classification Search

CPC . F41H 5/013; F41H 5/02; F41H 5/026; F41H 5/24; F41H 7/035

See application file for complete search history.

(56) References Cited

U.S. PATENT DOCUMENTS

| | | | |
|---|---|---|---|
| 3,348,466 | A | 10/1967 | Lane et al. |
| 4,683,688 | A | 8/1987 | Wojcinski |
| 5,405,673 | A | 4/1995 | Seibert |
| 5,452,641 | A | 9/1995 | Kariya |
| 5,641,933 | A | 6/1997 | Kim |

(Continued)

FOREIGN PATENT DOCUMENTS

| | | | |
|---|---|---|---|
| EP | 2781876 | A2 | 9/2014 |
| GB | 551198 | A | 2/1943 |

(Continued)

*Primary Examiner* — Stephen Johnson

(74) *Attorney, Agent, or Firm* — Morris, Manning & Martin, LLP; John R. Harris

(57) ABSTRACT

A modular ballistic barrier assembly for deployment in proximity to a protected high value asset such as electrical grid equipment. A ballistic barrier assembly comprises a plurality of prefabricated ballistic barrier panel units that can be stacked on top of each other. Each panel unit is made of spaced apart angled steel louvers or slats, arranged in one or more sections. The louvers are arranged in one or more vertically extending, spaced apart rows, having an outwardly facing row of louvers presenting a downwardly angled surface to an approaching projectile, and an inwardly facing row of louvers presenting a second layer of ballistics protection. Steel I-beam support columns are provided at spaced apart intervals to receive and support a stack of panel units. The panel units are made to interlock with vertically adjacent, stacked panels, so that multiple panel units can be stacked.

21 Claims, 13 Drawing Sheets

(56) References Cited

U.S. PATENT DOCUMENTS

| | | | | |
|---|---|---|---|---|
| 5,780,761 | A | 7/1998 | Musante et al. | |
| 6,672,195 | B1 | 1/2004 | Plattner | |
| 7,415,806 | B2 | 8/2008 | Davidson | |
| 7,546,795 | B1 | 6/2009 | Munson, Jr. | |
| 7,722,449 | B2 | 5/2010 | Nowak et al. | |
| 7,934,444 | B2 * | 5/2011 | Carberry | E04H 9/10 109/49.5 |
| 8,037,802 | B2 | 10/2011 | Ciriscioli et al. | |
| 8,904,915 | B2 | 12/2014 | Howland | |
| 2010/0206158 | A1 * | 8/2010 | Neethling | F41H 5/023 89/36.02 |
| 2013/0233164 | A1 * | 9/2013 | Kestermont | E04B 1/10 89/36.04 |
| 2014/0123842 | A1 | 5/2014 | Kahmann et al. | |

FOREIGN PATENT DOCUMENTS

| | | | |
|---|---|---|---|
| JP | 3268037 | B2 | 3/2002 |
| WO | 2014172463 | | 10/2014 |

* cited by examiner

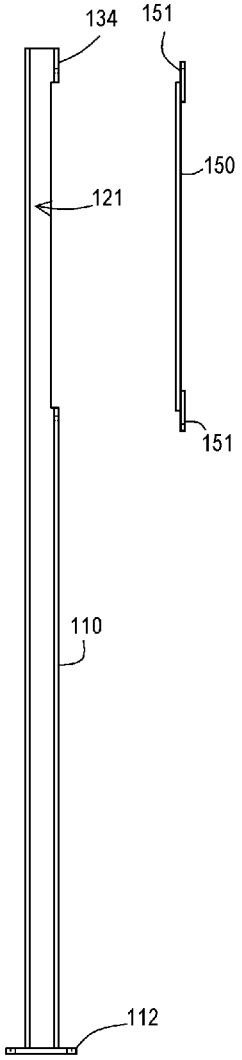
FIG. 8A
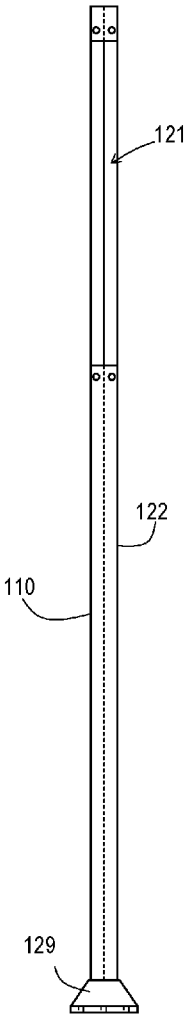
FIG. 8B
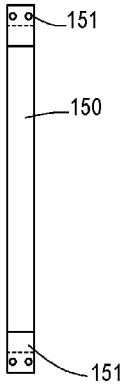
FIG. 8C
FIG. 8
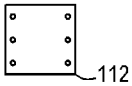
FIG. 8D
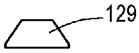
FIG. 8E

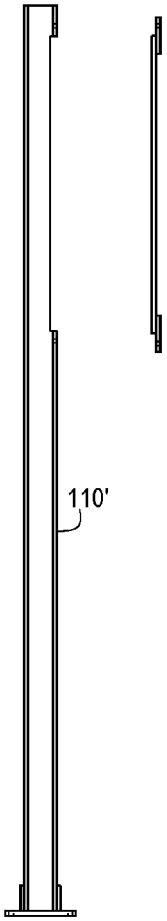
FIG. 9A
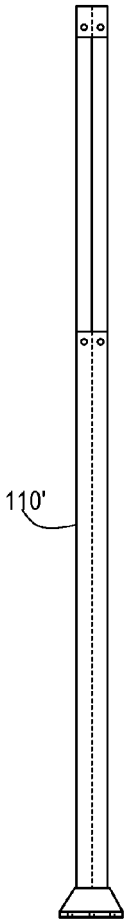
FIG. 9B
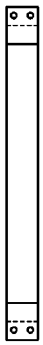
FIG. 9C
FIG. 9
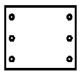
FIG. 9D
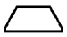
FIG. 9E

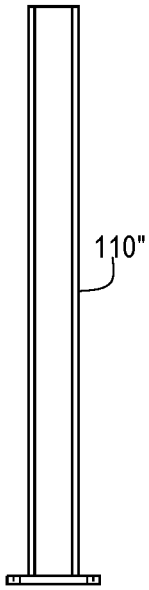
FIG. 10A
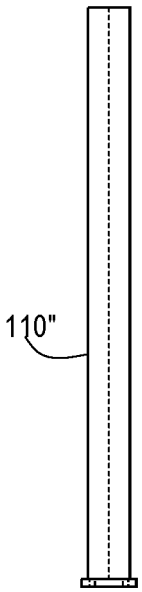
FIG. 10B
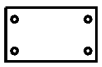
FIG. 10C
FIG. 10

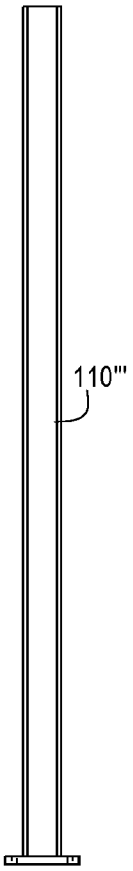
FIG. 11A
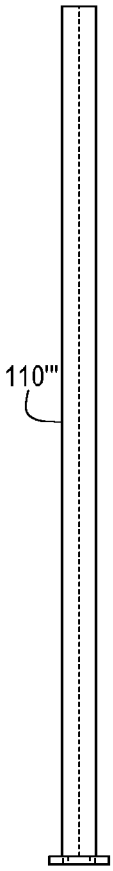
FIG. 11B
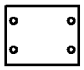
FIG. 11C
FIG. 11

Intermediate/Top
Panel Unit

ANTI-BALLISTIC BARRIER FOR HIGH VALUE FACILITIES PROTECTION SUCH AS ELECTRICAL GRID EQUIPMENT

CROSS-REFERENCE TO RELATED APPLICATION

This application claims benefit under 35 U.S.C. § 119(e) of U.S. Provisional Patent Application No. 62/198,424, filed Jul. 29, 2015, entitled "ANTI-BALLISTIC BARRIER FOR HIGH VALUE FACILITIES PROTECTION SUCH AS ELECTRICAL GRID EQUIPMENT," which is incorporated herein by reference as set forth herein in its entirety.

TECHNICAL FIELD

This disclosure relates generally to protection against ballistic weaponry such as firearms projectiles, shrapnel, collisions, etc., and more particularly relates to a modular anti-ballistic barrier for protection of sensitive high value facilities such as buildings, electrical grid, communications, and utility equipment, and the like.

BACKGROUND

Ballistic threats to high value facilities such as buildings, electrical grid equipment (substations with transformers and switches), communication equipment (cell towers), and utilities (pumping stations, water treatment facilities, etc.) are numerous and increasing. These facilities are considered high value because of the need for protection of human life in the case of buildings for housing and offices, as well as the significant cost in terms of activity continuity in the case of utility-type facilities such as electrical grid equipment, in particular. A case in point is the 2013 attack by suspected terrorists where automatic and sniper weapons fire was directed against radiators of certain large transformers in a San Jose, Calif. substation of Pacific Gas & Electric Co. (PG&E). Approximately $15 million in damage was suffered by the equipment, and a blackout was narrowly averted.

Aside from the known threats from terrorists and criminals, threats from careless or deliberate misuse of firearms are persistent with these facilities, which are often remotely located and prey to communications outages and temptations to unlawful firearms discharge.

There is a need for an effective, efficient, fast to construct, and economical way to protect high value facilities from these and similar kinds of ballistic attacks.

SUMMARY

Briefly described, there is disclosed a modular ballistic barrier assembly for deployment around a protected asset, such as high value facilities, in particular electrical grid equipment such as power voltage step-down transformers. In one aspect, the ballistic barrier assembly is intended to provide perimeter fencing for the protected assets.

A ballistic barrier assembly comprises a plurality of prefabricated ballistic barrier panel units that can be stacked on top of each other. Each panel unit is made of spaced apart angled steel louvers or slats, arranged in one or more sections. Steel I-beam support columns are provided at spaced apart intervals to receive and support a stack of panel units. The panel units are made to interlock with vertically adjacent, stacked panels, by having lowermost extent of a front-facing, bottommost louver extend downwardly beyond the bottommost extent of the pair of side supporting plates (to which the louvers are welded), such that the portion of the bottommost louver extends into the space of the panel unit to provide the requisite overlap with the rearward facing louver on the inner side of the lower adjacent panel unit. An angled notch is provided at the topmost extent of the end support plates in a lower panel unit, to receive the downwardly extending portion of the bottommost louver of a panel unit that is stacked atop of the lower panel unit. This allows multiple panel units to be stacked but provide a fully intact louver at the bottommost extent of a modular panel unit.

A ballistic barrier assembly includes a plurality of spaced-apart support columns that are mounted to pre-existing concrete footings, each of which include upwardly extending threaded studs or bolts, that extend through openings in a base plate that is welded to the bottom of a support column. The support columns are preferably I-beams, vertically mounted to the concrete footing.

According to one aspect, the I-beam support columns include pre-cut slots in one upper edge of a flange of an I-beam to allow a panel unit to be introduced and engaged horizontally into a pair of slots on a pair of I-beams, and allowed to slide between the I-beam flanges downwardly into a resting position, captured between the intact flanges. According to one embodiment for a three unit stack of panel units, the slot on each I-beam preferably extends approximately ⅓ of the extent of the support column, so that at least two panel units can be stacked and captured. A third panel unit can also be stacked on top of two panels, and then a cover plate is fastened to each of the support columns to retain the topmost panel unit. This approach allows introduction of the panel units into a slot without lifting the panel unit more than 24 feet high, and thereby avoids use of cranes that may risk contact with overhead power lines of a substation. The slot-introduction approach allows use of a forklift type lifting apparatus, to avoid use of cranes.

Preferably, the slots in the support columns are the same size as one of the panel units, but the topmost portion of the support column has a portion of the I-beam intact so as to provide a surface for mounting a cover plate to retain the topmost panel of a group of stacked panels. The surfaces of the support columns include a plurality of openings for receiving fastening bolts that support a cover plate that covers the slot, and aids in retaining and holding the panel unit in position stacked atop one or more lower panel units.

These and other aspects, features, and benefits of the claimed invention(s) will become apparent from the following detailed written description of the preferred embodiments and aspects taken in conjunction with the following drawings, although variations and modifications thereto may be effected without departing from the spirit and scope of the novel concepts of the disclosure.

BRIEF DESCRIPTION OF THE DRAWINGS

The accompanying drawings illustrate one or more embodiments and/or aspects of the disclosure and, together with the written description, serve to explain the principles of the disclosure. Wherever possible, the same reference numbers are used throughout the drawings to refer to the same or like elements of an embodiment, and wherein:

FIG. 8, consisting of FIGS. 8A through 8E, shows one embodiment of an I-beam supporting column.

FIG. 9, consisting of FIGS. 9A through 9E, shows another embodiment of an I-beam supporting column.

FIG. 10, consisting of FIGS. 10A through 10C, shows another embodiment of an I-beam supporting column.

FIG. 11, consisting of FIGS. 11A through 11C, shows yet another embodiment of an I-beam supporting column.

DETAILED DESCRIPTION

Turning now to the drawings, in which like numerals indicate like elements throughout the several drawing figures, there is disclosed an anti-ballistic barrier assembly 100 for high value facilities that comprises an arrangement of generally rectangular steel louvered panels or panel units 115 that are stacked within spaced-apart steel support columns 110 to provide a highly customizable but modular barrier assembly. The panel units 115 are of a uniform size, typically preconstructed off the site of the protected facility. The panel units comprise a plurality of spaced apart, angled, ballistic-deflecting louvers, preferably in two adjacent layers, but other arrangements are contemplated. The angle of the louvers is selected to provide for deflection of projectiles, but spaced apart to provide for air flow into the space near the protected facility.

Figure 1:
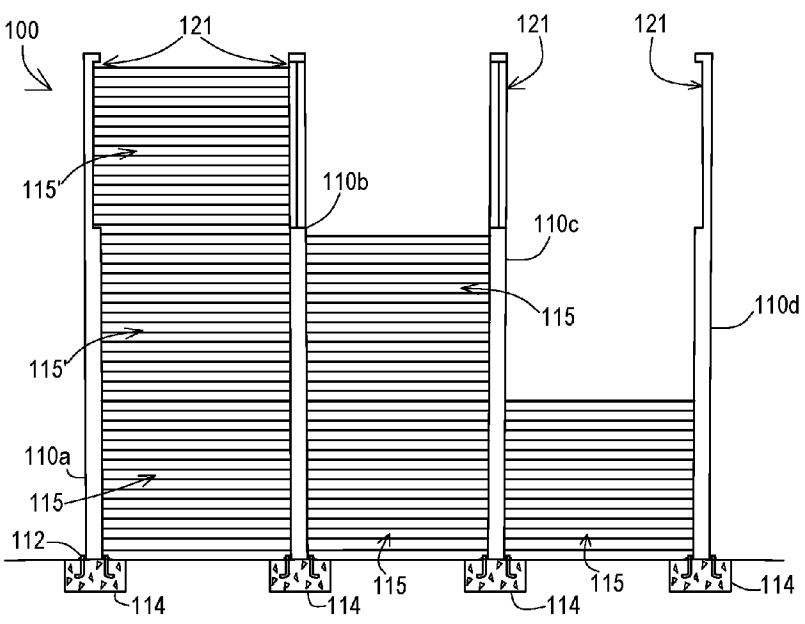
FIG. 1 is an elevation view of an anti-ballistic barrier assembly according to one embodiment of the disclosure, comprising a plurality of stacked panel units.

FIG. 1 shows an elevation view of a single ballistic barrier assembly 100 comprising, in this aspect, four spaced apart vertical support columns 110*a*-110*d*, that house and support up to three louvered panel units 115, for a total of nine panel units in this example. Note that only six panel units 115 are shown in FIG. 1, so as to illustrate the stacked relationship of the panel units.

According to an aspect, each assembly includes a bottom panel unit 115 that rests adjacent the ground, and one or more intermediate and/or top panel units 115' that rest atop a bottom panel unit 115. The panel units 115, 115' are similarly constructed, except that a bottom panel unit 115 is constructed to be flush with the ground (or horizontal surface beneath), while the intermediate or top panels unit(s) 115' are constructed to rest atop another, lower panel unit (whether intermediate or top), and have a downwardly projecting portion of a louver, as will be described below.

Each support column 110 comprises a vertically mounted I-beam, having a base plate 112 welded to the bottom of the I-beam. The base plate is preferably bolted to a concrete support pad 114 that includes upwardly extending threaded anchor bolts that extend through openings in the base plate and receive threaded nuts to fasten the I-beam to the support pad.

As shown in FIG. 1, each pair of support columns, e.g. 110*a*, 110*b* supports up to three louvered ballistic panel units 115 in a stack. Details of the louvers are provided below. The support columns 110*b*, 110*c* are shown supporting two panel units 115, with the topmost position of three empty to reveal slots 121 in the support columns for receiving the panel units during assembly. The slots 121 allow introduction of a panel unit in generally horizontal movement (as shown in FIG. 2).

Figure 2:
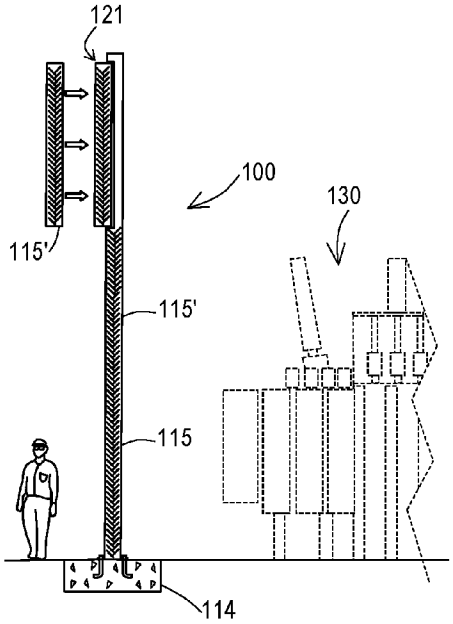
FIG. 2 is a side elevation/cross sectional view of an anti-ballistic barrier assembly.

As shown in FIG. 2, a barrier assembly 100 may be positioned in proximity to a high value asset to be protected, for example, electrical equipment 130 such as transformers and switches. A barrier assembly 100 constructed as described herein may include any number of support columns 110, arranged to make a wall, for example up to 25 feet high, made of modular eight foot panel units, to protect against ballistic projectiles, shrapnel, and other attacks such as flames or impact by explosives or vehicles, etc. As shown in FIG. 2, a bottom panel unit 115 rests on the ground in a lowermost position, and one or more top or intermediate panel units 115' are placed on top of the bottom panel unit, by slidable insertion into the slot 121 in a support column 110.

Figure 3:
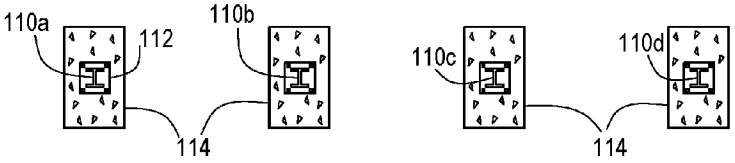
FIG. 3 is a plan view of a mounting I-beams supporting column for supporting one or more panel units.

FIG. 3 shows a plan view of four concrete footings 114 that can support four support columns 110*a*-110*d*, for example as shown in FIG. 1, which in turn can support three sections of barriers, each section comprising three panel units 115 as shown in FIG. 1.

Figure 4:
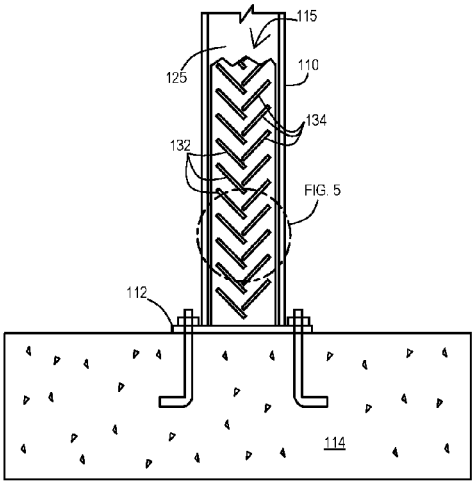
FIG. 4 is a partial cross-section view of a portion of a panel unit and an I-beam supporting column.

FIG. 4 is a detailed partial cross-sectional view of a panel unit 115, mounted to an exemplary concrete pad 114. The panel unit 115 in this figure is shown supported within an exemplary support column 110. Each panel unit 115 comprises a plurality of spaced apart louvers, in two layers or rows. Each louver (a/k/a "louvre") is one of set of steel angled slats or flat strips fixed at regular intervals in a panel unit, with spacing as to allow air to pass through. In one aspect, there is a layer or row of outwardly facing louvers 132, positioned to engage a ballistic threat, and an adjacent but spaced apart layer or row of inwardly facing louvers 134. The louvers 132, 134 are preferably welded to end support plates 125, such that both layers of louvers 132, 134 present a downwardly facing surface to any entering projectile. The louvers generally form a "V"-shape when seen in cross-section, but with the lowermost edges of the louvers being spaced apart from the adjacent louvers both on the same layer and from the other layer, to provide for air flow and room for deflection of projectiles.

According to one aspect, each panel unit 115 comprises a pair of vertically extending end support plates 125, one of which is shown cut away in FIG. 4 to reveal outer louvers 132 and inner louvers 134. The outer louvers 132 are welded into slots (not shown in FIG. 4) cut into the end support plates 125, or alternatively welded directly onto the surface of the end support plates. Preferably, the louvers on both sides are welded at an angle of about 30° relative to horizontal on the front side (about 150° relative to horizontal on the back side), although the inventor believes that this angle may be varied about ±10° and still be effective to protect against significant ballistic threats such as high caliber projectiles.

Figure 5:
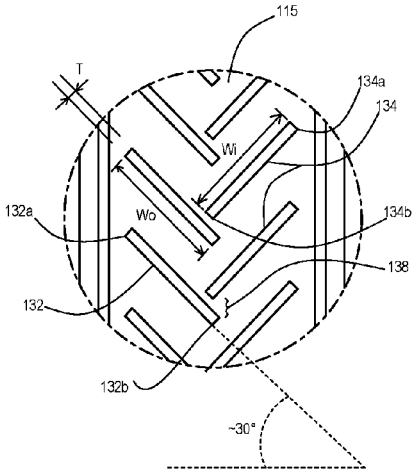
FIG. 5 is a detailed cross-sectional view of a portion of a panel unit.

FIG. 5 is an expanded view of the circular section in FIG. 4. In FIG. 5, each outer louver 132 is preferably of a width $W_O$ so that the bottommost edge or extent 132*b* of one louver extends sufficiently below the bottommost edge or extent 132*b* of an immediately adjacent louver 132, above and below it in the same layer. This would provide that any projectile impacting a louver 132, if it penetrated, would encounter either the downwardly extending edge of the immediately adjacent outer louver 132, or a portion of an inner louver 134.

As seen in FIG. 5, the panel unit 115 preferably comprises a plurality of outer louvers 132, facing outwardly of the assembly 100 to engage the ballistics threat, and a plurality of inner louvers 134, facing inwardly of the assembly, facing the protected assets. Preferably, the bottommost extent or edge 134*b* of an inner louver 134 is positioned in between the bottommost extent or edges 132*b* of a pair of horizontally adjacent outermost louvers 132, but spaced apart similarly to the spacing of the outermost louvers 132. This arrangement ensures that any projectile or fragments are highly likely to impact at least two louvers, even if penetrating one louver, and increases the likelihood that the projectile will impact two or more surfaces of louvers. The high likelihood of multiple impacts of projectiles against the louvers increases the probability that any projectile or fragment will either disintegrate due to the multiple impacts or dissipate sufficient energy to render it relatively harmless.

According to one aspect, each inner louver 134 is preferably of a width $W_i$ so that the bottommost edge or extent 134*b* of one louver extends sufficiently below the bottommost edge or extent 134*b* of an immediately adjacent louver 134, above and below it in the same (inner) layer.

According to one aspect the thickness T of the louvers 132, 134 may be the same, or in another aspect may be different. In one aspect, the louvers 132 are ⅜ inch AR500 steel. In another embodiment, the louvers are ¼ inch AR500 steel. In another aspect, the louvers are ⅜ inch thick AR500 steel. In another embodiment, the louvers are a combination of ⅜ inch AR500 steel on the outside and ⅜ inch A36 mild steel on the inside. In another embodiment, the louvers are a combination of ¼ inch AR500 steel on the outside and ¼ inch A36 mild steel on the inside. In yet another aspect, there may be only a single row (outside) of louvers, i.e. only the outside louvers 132, fabricated of ⅜ inch AR500 steel. In yet another aspect, there may be only a single row (outside) of louvers, i.e. only the outside louvers 132, fabricated of ¼ inch AR500 steel. Other arrangements and combinations of materials, thickness, and other dimensions for the louvers are also contemplated.

Moreover, the panel units 115 and louvers 132, 134 are preferably mounted such that any projectile will be deflected in a downward direction, and any dissipated projectiles or fragments will fall downwardly and eventually out of the panel unit.

In one aspect, the spacing between louvers 132, 134, of both layers or rows of louvers, provides a substantially vertical space 138 that permits sufficient air flow, but causes any flames or explosion plasma to change directions one or more times to aid in flame dissipation and blast deflection.

In another aspect, as seen in FIG. 5, the topmost extent of one louver e.g. 132*a* is positioned to horizontally overlap a portion of the horizontal adjacent louver e.g. 132*b* so that there is no direct horizontal path of a projectile through a single louver. Based on this arrangement, there is no path for an incoming projectile that would only impact a single louver. Even an angularly downwardly directed projectile at 30° travelling parallel between two front facing louvers would necessarily impact at least one interior facing louver, and would most likely impact at least two louvers.

Figure 6:
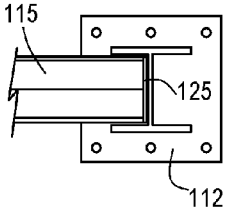
FIG. 6 is a plan view of a base plate for supporting an I-beam supporting column.

FIG. 6 illustrates a base plate 112 from a top plan view, showing details of a support column 110, with an included panel unit 115 retained within the flanges of the I-beam-shaped support column.

Figure 7:
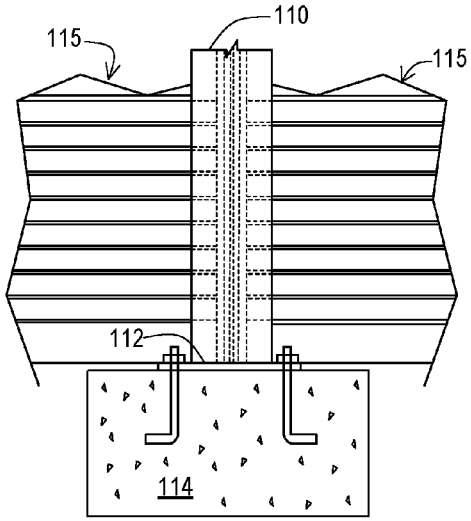
FIG. 7 is an elevation view of a footer, an I-beam supporting column, and a pair of adjacent panel units.

FIG. 7 is a partial front elevation view of a concrete support pad 114, with base plate 112 affixed thereto by anchor bolts and nuts, supporting a support column 110 having a pair of panel units contained within the opposing flanged regions of the I-beam-shaped column.

FIG. 8, consisting of FIG. 8A through 8E, illustrates a single support column 110, in multiple views, formed from a W8X67 I-beam. FIG. 8A is a side view of a support column, showing the slot 121 at the upper end of the column for receiving a panel unit 115 (not shown). A portion of a flange of the I-beam is cut away to form the slot 121. Note that the upper end 134 of the column 110 is intact (in the I-beam shape), to provide a surface for receiving and mounting a cover plate 150. Once a panel unit 115 is inserted into the slot 121, it may be lowered into the U-shaped area formed by the flanges of the I-beam and retained therein.

FIG. 8B shows a front view of the support column 110, showing the slot 121, with the entirety of a section of the flange 122 cut away to allow a slot 121 on each side of the "I" of the beam. Such a structure is preferably used for the interior support columns 110 of an assembly 100.

FIG. 8C shows a retaining or cover plate 150 may be formed from the removed portion of a flange of an I-beam. Preferably, support plates 151 are welded at each end of the cover plate 150, with bolt mounting holes, to support and retain the cover plate 150 in position to retain a panel unit 115 contained within the slot 121.

FIG. 8D shows a base plate 112, in this case having six mounting holes for receiving anchor bolts from a footing.

FIG. 8E shows a trapezoidal bracket plate 129, which can be welded at an angle between a base plate 112 and a support column 110 to provide additional support for wind load or impact resistance.

FIG. 9, consisting of FIG. 9A through 9E, shows another embodiment of a support column 110', which is essentially the same as that shown in FIG. 8, except employing a larger I-beam (W10X77) used as the support column.

FIG. 10, consisting of FIG. 10A through 10C, shows another configuration of a support column 110", which may be used to construct a ballistic barrier assembly 100 having only a single eight foot panel unit 115 (not shown). Such a configuration would only be a single panel in height. It will of course be appreciated that the panel units can be made to any particular height, provided that overhead field mounting and avoidance of obstacles or risks such as overhead power lines is taken into account.

FIG. 11, consisting of FIG. 11A through 11C, shows yet another configuration of a support column 110'", which may be used to construct a ballistic barrier assembly 100 having a pair of eight foot stacked panel units 115 (not shown). Such a configuration would two panels in height. It will of course be appreciated that the panel units can be made to any particular height, provided that overhead field mounting and avoidance of obstacles or risks such as overhead power lines is taken into account. In the case of a two stacked panel support column 110''', there may be no need to provide the insertion slot 121, as some applications involving two stacked panels can be assembled by top entry without extending more than 25 feet in height, which is typically sufficient to avoid overhead power lines in many electrical equipment installations.

Figure 12:
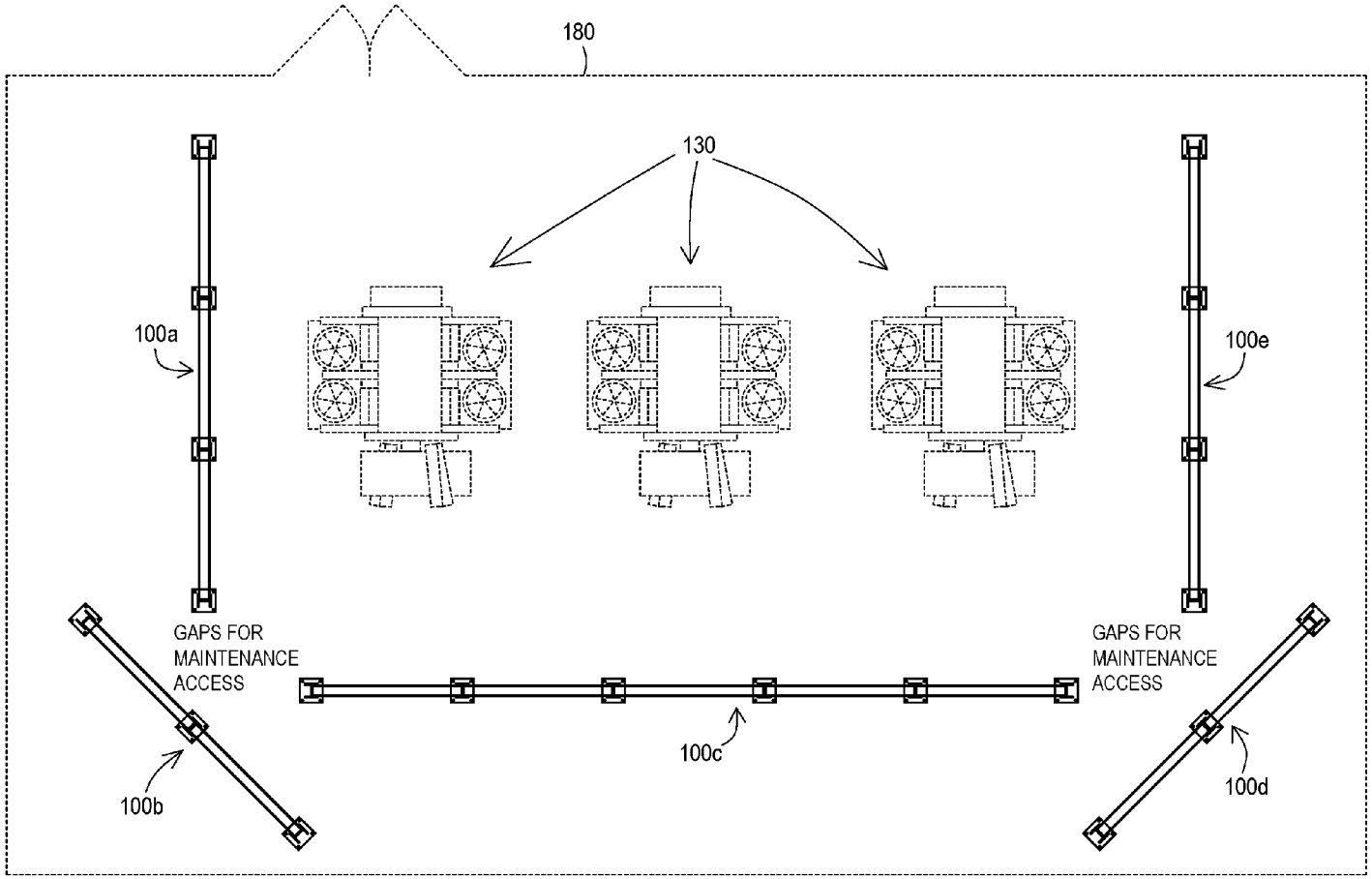
FIG. 12 is a plan view of a protected asset including a plurality of anti-ballistic barrier assemblies arranged to form a protective fence.

FIG. 12 illustrates an exemplary application of a plurality of ballistic barrier assemblies 100 constructed as described herein, configured to protect substation electrical equipment, e.g. transformers 130. In this exemplary configuration, a grouping of five barrier assemblies 100*a* through 100*e*, is arranged to enclose the electrical equipment 130 on three sides (it being assumed in this case that the electrical equipment is otherwise protected from ballistic threats by a building, geography, etc.). A first assembly 100*a* is positioned on the left side of the equipment, and comprises four support columns, housing up to nine eight foot panel units, stacked three by three. A second assembly 100*b* is positioned at an angle to the first assembly 100*a* on the left side of the equipment, and comprises three support columns, housing up to six panel units, stacked two by three. A third assembly 100*c* is positioned perpendicular to the first assembly 100*a* in front of the equipment, and comprises six support columns, housing up to fifteen panel units, stacked five by three. A fourth assembly 100*d* is positioned at an angle to the third assembly 100*c* on the right side of the equipment, and comprises three support columns, housing up to six panel units, stacked two by three; this assembly 100*d* is similar to the second assembly 100*b*. A fifth assembly 100*e* is positioned on the right side of the equipment, perpendicular but spaced apart from the third assembly unit 100*c*, and comprises four support columns, housing up to nine 8 foot panel units, stacked three by three.

According to an aspect, in FIG. 12 the angled second and fourth assemblies 100*b*, 100*d* are spaced apart from the first, third, and fifth assemblies, 100*a*, 100*c*, 100*d* to provide a maintenance access gap to the equipment for personnel and certain appropriately sized equipment. It will be noted that this arrangement allows easy ingress and egress for personnel with a gate or other movable barrier, but still provides the ballistic protection on all three sides.

Although FIG. 12 shows only three sides protected by the disclosed ballistic barrier assemblies 100*a*-110*e*, all four sides could be provided with protective ballistic barrier assemblies. FIG. 12 illustrates the fourth side as protected by a fence 180, which is shown merely to illustrate the versatile arrangement of the disclosed embodiments. It will therefore be appreciated that other configurations and arrangements of assemblies 100 are possible, to provide for protection on all four sides of protected assets.

Preferably, all components in the assembly 100 are made of galvanized steel for weather protection, using AR500 steel.

Preferably, the angles for mounting the louvers 132, 134 are sufficiently acute that most if not all impacting projectiles will strike the louvers at an angle that will deflect the projectiles downwardly onto another, adjacent louver for additional energy dissipation and disintegration.

In one configuration, the louvers 132 on one side (the outer threat-facing side) of an assembly 100 have a greater width $W_O$ than the width $W_i$ of louvers 134 on the other side (the inner facing, protected side), to provide overlap of the louvers and increase the overlap.

Figure 13:
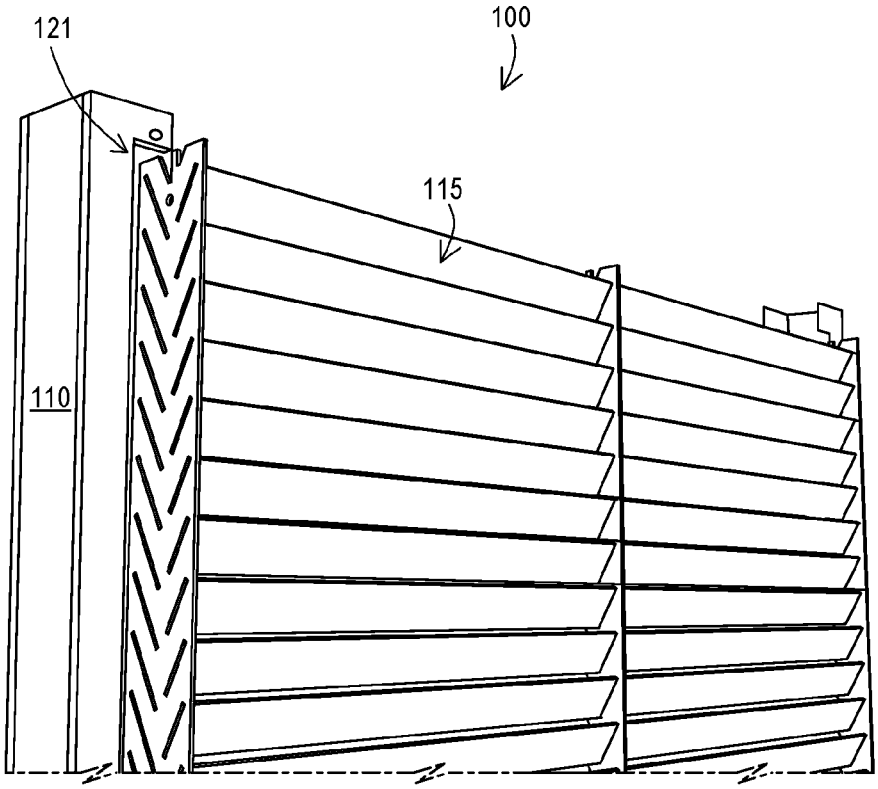
FIG. 13 is a perspective partial view showing a ballistic barrier assembly with a single panel unit being inserted into a slot in a supporting column.

FIG. 13 illustrates a ballistic barrier assembly 100 with a single panel unit 115 being inserted into a slot 121 in a support column 110.

Figure 14:
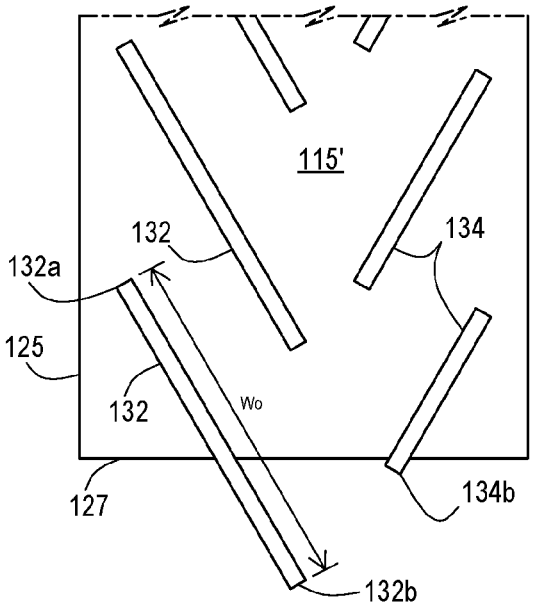
FIG. 14 is a partial elevation view showing a bottom portion of a panel unit and louver arrangement.

FIG. 14 illustrates a bottom portion of an intermediate or top panel unit 115', with outer louvers 132, inner louvers 134, where the bottommost extent 132*b* of the bottom louver of such a panel unit 115' extends below the lowermost extent 127 of the end support plate 125. According to one aspect, this allows panel units 115' to be stacked on top of each other, while still providing the full extent of protection of the full width $W_O$ of an outer louver 132. As discussed below, provision is made to accommodate this overlap or downwardly-handing portion of the bottommost louver 132*b* in a slot or notch 137 of an end support plate 125 of a lower, adjacent panel unit (bottom, top, or intermediate), as seen in FIG. 15 and FIG. 16.

According to one aspect, the bottommost extent 134*b* of an inner louver 134 extends slightly beneath the lowermost extent 127 of the end support plate 125. This bottommost extent 134*b* is accommodated, in this aspect, in a second notch or recess 139 of an end support plate 125 of a lower, adjacent panel unit (bottom, top, or intermediate), as seen in FIG. 15 and FIG. 16.

Figure 15:
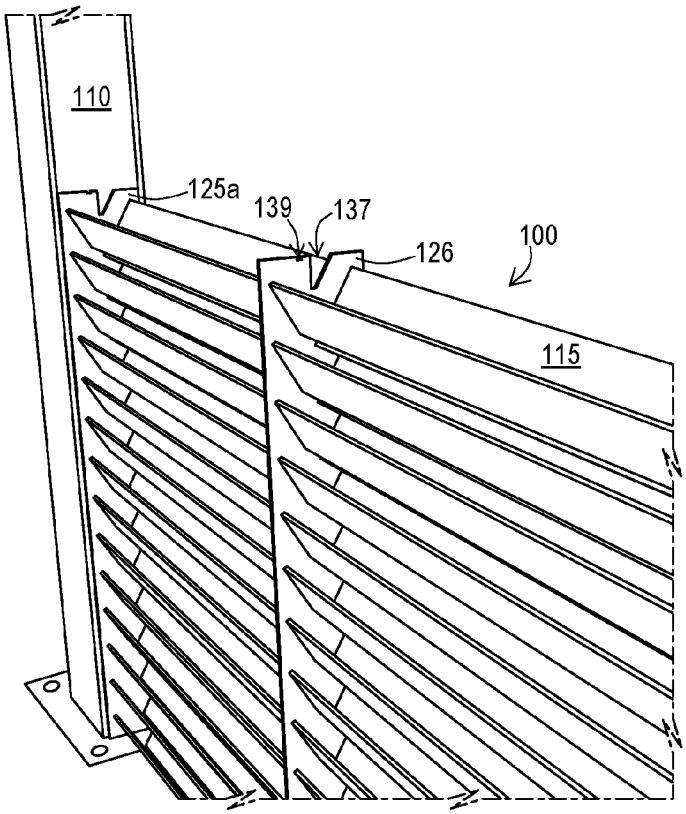
FIG. 15 is a perspective partial view of another embodiment of a panel unit having a central plate for supporting louvers.

FIG. 15 illustrates another embodiment of a panel unit 115' having a central plate 126 for supporting louvers. This photograph shows a partial assembly 100 that comprises two separate end plates 125*a*, 125*b* (not shown), with a central plate 126, which forms two separate sections of louvers for a single panel unit 115', which is received within support columns 110. Such an arrangement provides for greater lateral rigidity and strength in supporting the louvers 132, 134.

Figure 16:
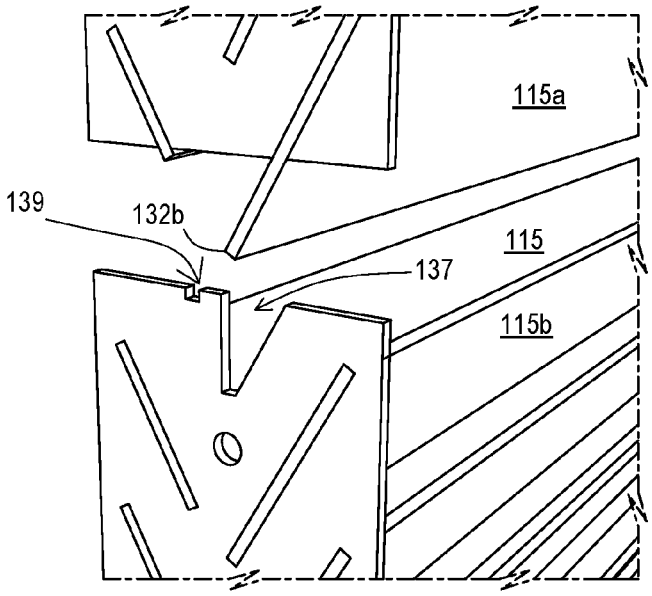
FIG. 16 is a perspective partial view of two vertically adjacent panel units, showing the notched arrangement on a lower panel unit for receiving a louver from an upper panel unit.

FIG. 16 illustrates a panel unit 115 according to another aspect, showing how two panel units 115*a*, 115*b* are stacked on top of each other, while allowing the bottommost portion 132*b* of the bottom louver 132 of an upper unit 115*a* to provide for full coverage of the louver and overlap with a portion of the bottom unit 115*b* by extending within a notch 137 in the bottom unit 115*b*. FIG. 16 shows the downwardly extending bottommost portion 132*b* of the lowermost louver in the unit 115*a*, and a corresponding notch 137 formed in the central plate 126 (for an embodiment such as shown in FIG. 15) for receiving the louver bottommost portion 132*b* when an upper panel unit 115*a* is stacked on top of a lower panel unit 115*b*. It will also be appreciated that the end support plates 125 will typically also include a similar notch (not shown in the drawings).

According to another aspect, FIG. 16 also illustrates how the bottommost portion 134*b* of the bottom inner louver 134 of an upper unit 115*a* extends slightly within a second notch or recess 139 in the bottom unit 115*b*. FIG. 16 shows the downwardly extending bottommost portion 134*b* of the lowermost inner louver 134 in the unit 115*a*, and a corresponding second notch or recess 137 formed in the central plate 126 (for an embodiment such as shown in FIG. 15) for receiving the louver bottommost portion 134*b* when an upper panel unit 115*a* is stacked on top of a lower panel unit 115*b*. It will also be appreciated that the end support plates 125 will typically also include a similar notch (not shown in the drawings).

Figure 17:
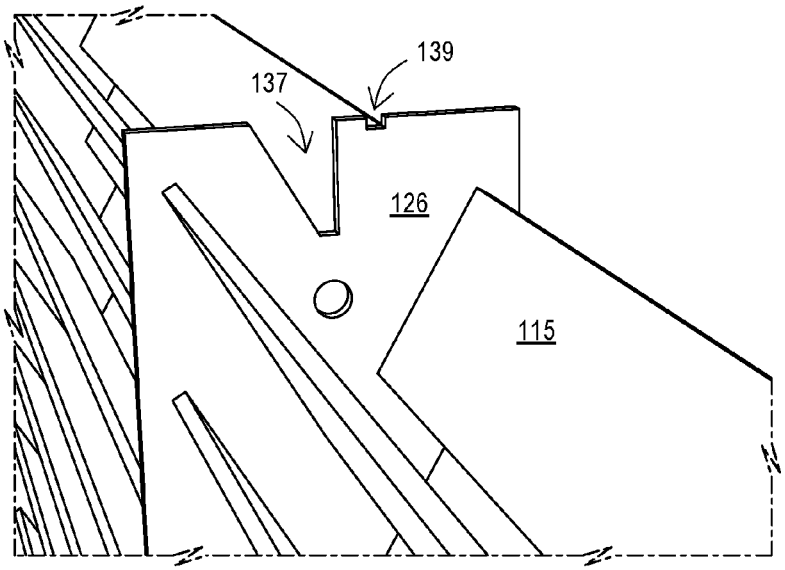
FIG. 17 is a perspective partial view of a portion of a panel unit that shows a notch in a central support plate.

FIG. 17 further illustrates a portion of a panel unit 115 that shows the notch 137 in a central support plate 126, and also a second notch or recess 139.

Figure 18:
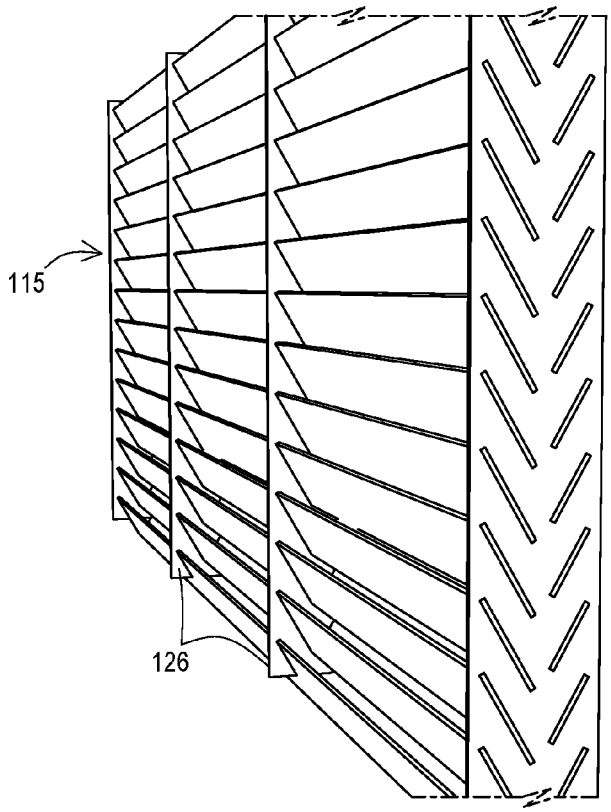
FIG. 18 is a perspective partial view of a two-section panel unit according to one aspect.

FIG. 18 illustrates a three-section panel unit 115 according to one aspect, showing the acute angles of the louvers 132, 134, and having multiple central plates 126.

Figure 19A:
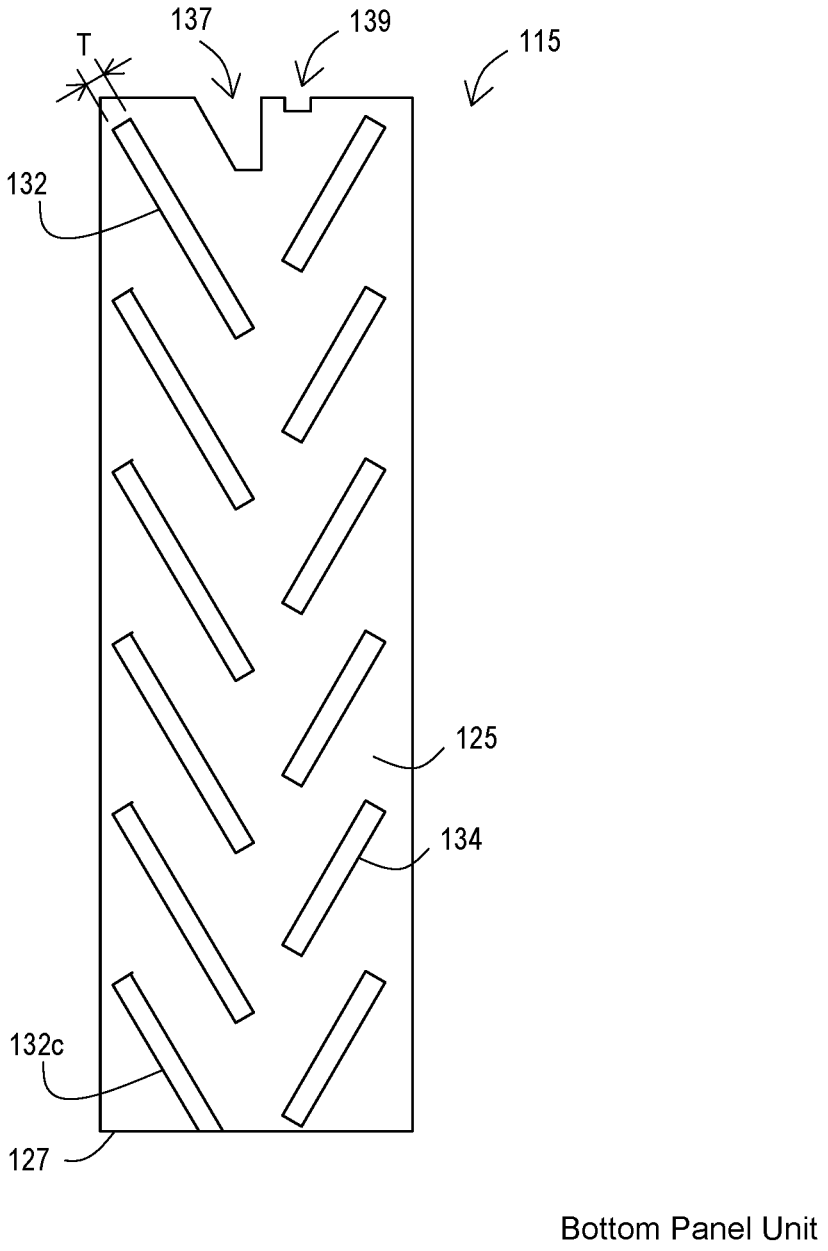
FIG. 19, consisting of FIG. 19A and FIG. 19B, shows a ballistic barrier according one aspect of the disclosure, in the form of a bottom panel unit and an intermediate and/or top panel unit for stacking on top of another panel unit.
Figure 19B:
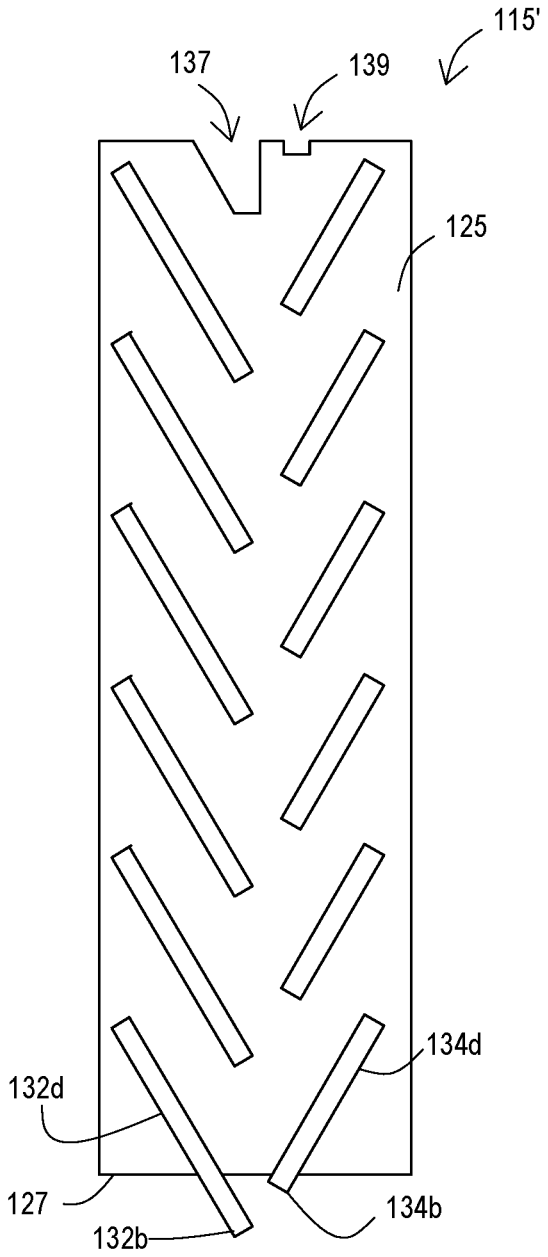

FIG. 19, consisting of FIG. 19A and FIG. 19B, illustrate a bottom panel unit 115 and an intermediate and/or top panel unit 115', respectively. FIG. 19A shows a preferred arrangement for the louvers 132, 134, relative to an exemplary support plate 125, of an exemplary bottom or lowermost panel unit 115. In one embodiment, the louvers 132, 134 are each mounted at an angle of about 30° relative to vertical.

In one embodiment, the support plate 125 is about 6.432 inches wide, and has a preferred thickness of 0.375 inches (or 0.250 inches, in an alternative embodiment having thinner louvers). The front or outwardly facing louvers 132 are each about 5 inches in width $W_O$ (see FIG. 5), and the rear or inwardly facing louvers 134 are about 3.5 inches in width $W_1$. The thickness T for the louvers 132, 134 is chosen for anti-ballistic strength or resistance, versus weight and cost, as within the discretion of one skilled in the art. The thickness T of the louvers 132, 134 is preferably between about ⅜ inch and ¼ inches, and can be formed of various combinations of thickness and type of steel, for inner and outer louvers, to balance factors of weight, cost, and anti-ballistic resistance capability.

According to one aspect, the front facing or outer louvers 132 are parallel and spaced apart from each other at about 1.3236 inches, measured face-to-face between the parallel faces. Similarly, the rear facing or inner louvers 134 are parallel and spaced apart from each other at about 1.3057 inches, measured face-to-face between the parallel faces.

In one aspect, the front or outwardly facing louvers 132 are positioned (recessed) relative to a front edge of the support plate 125 about 0.3204 inches. In this configuration with a 6.432 inch wide support plate 125, the rear or inwardly facing louvers 134 are positioned relative to the front louvers 132 at a preferred distance of 1.3714 inches, measured along a horizontal line extending from the bottommost edge of a rear louver 134, until that horizontal line intersects with the rear-facing surface of a front louver 132. This exemplary spacing is believed to provide for acceptable air flow through a panel unit, while also providing for a high degree of ballistics protection.

Measured another way, for an exemplary configuration with a 6.432 inch wide support plate 125, the rear or inwardly facing louvers 134 are positioned relative to the front louvers 132 at a preferred distance of 1.7982 inches, measured along a horizontal line extending from the bottommost edge of a front louver 132, until that horizontal line intersects with the front-facing surface of a rear louver 134. In this configuration, the rear or inwardly facing louvers 134 are positioned (recessed) relative to a back edge of the support plate 125 about 0.5260 inches.

As can be seen and will be appreciated, in such an exemplary configuration, which is preferred, there is no path for a projectile impacting a panel unit that can encounter only a single louver—the reasonably expected angles of impact will encounter at least two louver surfaces, even if the projectile enters at an angle of 30° travels a path between two front louvers 132, the projectile will encounter a first rear louver 134 and if it penetrates the first rear louver, will encounter a surface of a second rear louver. However, it is believed most likely that a projectile will encounter a front louver 132 and be deflected.

Note in FIG. 19A that the lowermost louver 132*c* in the row of outer louvers does not extend below the bottommost extent 127 of the support plate 125 (or central support plate 126, if provided), this being a bottom panel unit 115 that is intended to sit flush on the ground or other generally horizontal surface.

FIG. 19B shows an exemplary intermediate and/or top panel unit 115'. Note in FIG. 19B that the lowermost louver 132*d* in the row of outer louvers extends as a portion 132*b* below the bottommost extent 127 of the support plate 125 (or central support plate 126, if provided), with such portion 132*b* to be accommodated into a notch 137 in an immediately adjacent lower assembly (not shown), this being an intermediate or top panel unit 115' that is intended to be stacked on top of another panel unit 115 (whether bottom or intermediate). Similarly, in this aspect, the lowermost inner louver 134*d* in the row of inner louvers extends slightly as a portion 134*b* below the bottommost extent 127 of the support plate 125 (or central support plate 126, if provided), with such portion 134*b* to be accommodated into a second notch or recess 139 in an immediately adjacent lower assembly (not shown).

Figure 20:
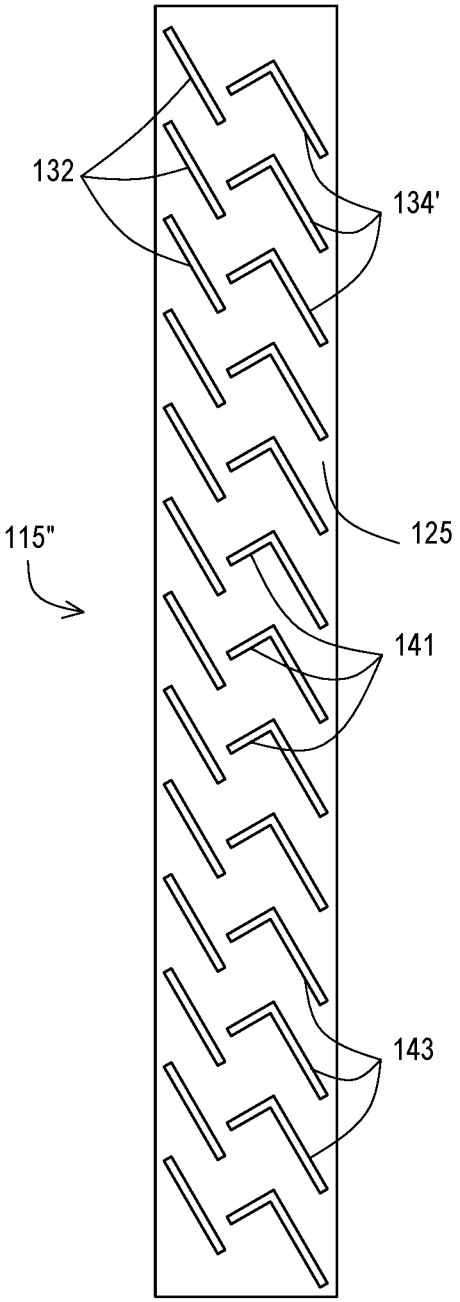
FIG. 20 shows another embodiment of a ballistic barrier according to the disclosure.

FIG. 20 shows yet another embodiment of a panel unit 115", according to another aspect. The panel unit 115" comprises a row of outer louvers 132, constructed similar to that as described above, and a row of inner but "L" shaped louvers 134', mounted in an inverted position. In such an embodiment, the material may be a combination of 5/16 inch steel for the outer louvers and ¼ inch mild steel for the inner louvers 134'. Such an embodiment will be of less weight for a typical arrangement of a four foot by ten foot panel unit, than an embodiment made of AR500 or A36 mild steel, but still deflect and resist penetration of high caliber ammunition such as 30 caliber, e.g. .300 Winchester magnum ("Win Mag"), 180 grain. The disclosed arrangement comprises positioning the "L" shaped louvers 134' such that end 141 of the shorter leg of the "L" is spaced apart a predetermined distance but overlapping with a portion of an adjacent outer louver 132, with the apex of the "L" pointing upwardly, and the longer portion 143 of the "L" angled downwardly from the apex and at an angle similar to that of the outer louvers 132, e.g. 30°.

The foregoing description of the exemplary embodiments has been presented only for the purposes of illustration and description and is not intended to be exhaustive or to limit the inventions to the precise forms disclosed. Many modifications and variations are possible in light of the above teaching.

The embodiments were chosen and described in order to explain the principles of the inventions and their practical application so as to enable others skilled in the art to utilize the inventions and various embodiments and with various modifications as are suited to the particular use contemplated. Alternative embodiments will become apparent to those skilled in the art to which the present inventions pertain without departing from their spirit and scope. Accordingly, the scope of the present inventions is defined by the appended claims rather than the foregoing description and the exemplary embodiments described therein.

What is claimed is:

1. A modular ballistic barrier assembly for deployment at a site in proximity to a protected asset, comprising:

a plurality of prefabricated ballistic barrier panel units that can be stacked on top of each other, each said panel unit comprising a plurality of spaced apart angled steel louvers or slats, arranged in one or more sections, the louvers mounted between one or more vertically extending end support plates:

a plurality of vertically extending support columns provided at spaced apart intervals to receive and support a stack of one or more of said panel units between one or more pairs of said support columns, each of said support columns including a slot positioned at a top end of the support column and a flange positioned below the slot and extending the length of the support column, such that one of said panel units may be placed into position by horizontal insertion into the slot and vertical downward movement into the support column is confined by the flange;

wherein at least one of the said panel units is configured as an upper panel unit to rest atop a vertically adjacent, stacked panel unit as lower panel unit;

whereby multiple panel units can be stacked by insertion into the slot of the support columns;

wherein said support columns are mounted in an arrangement at the site in proximity to a protected asset prior to receiving said panel units to form a completed ballistic barrier assembly, wherein said panel units are inserted into a pair of support columns at the site to form said completed ballistic barrier assembly;

wherein said upper panel unit is configured to interlock with said lower panel unit, and wherein a lowermost extent of a front-facing, bottommost louver in said upper panel unit extends downwardly beyond a lowermost extent of a pair of support plates, such that a portion of said bottommost louver of said upper panel unit extends into a space defined in said lower panel unit and overlaps with a portion of a rearward facing louver on an inner side of said lower panel unit.

2. The ballistic barrier assembly of claim 1, wherein said end support plates include an angled notch provided at a topmost extent in said lower panel unit, to receive a downwardly extending portion of the bottommost louver of one of said upper panel units that is stacked atop of said lower panel unit, whereby multiple panel units can be stacked but provide a louver of full width at a bottommost extent of a modular panel unit that is an upper panel unit.

3. The ballistic barrier assembly of claim 1, wherein said support columns are mounted to pre-existing concrete footings, each of which include upwardly extending threaded studs or bolts that extend through openings in a base plate that is welded to a bottom of each said support column.

4. The ballistic barrier assembly of claim 3, wherein each of said support columns are steel I-beams vertically mounted to one of said concrete footings.

5. The ballistic assembly of claim 3, wherein said support columns including said slot are pre-cut slots in one upper edge of a flange of an I-beam to allow one of said panel units to be introduced and engaged horizontally into said slot including a pair of slots on a pair of I-beams, and allowed to slide between a pair of flanges of an I-beam downwardly into a resting position, captured between said flanges of said I-beam.

6. The ballistic barrier assembly of claim 5, wherein each pair of support columns contains a three unit stack of said panel units, the slot on each I-beam preferably extends approximately ⅓ of the length of said pair of support columns, so that at least two of said panel units can be stacked and captured within said flanges of the I-beam.

7. The ballistic barrier assembly of claim 6, wherein a cover plate is affixed to each of the support columns to retain a topmost panel unit of a three unit stack of said panel units.

8. The ballistic barrier assembly of claim 7, wherein said slots in said support columns are of a size about the same as a height of one of said panel units, and wherein a portion of said support column provides a surface for mounting said cover plate to retain the topmost panel of a stacked group of said panel units.

9. The ballistic barrier assembly of claim 8, wherein said support columns include a plurality of openings for receiving fastening bolts that support said cover plate to cover the slot and retain and hold a topmost one of said panel units in position stacked atop one or more of said panel units.

10. The ballistic barrier assembly of claim 1, wherein each said panel unit comprises a plurality of generally parallel, angled, spaced apart louvers arranged in two rows, wherein said louvers comprise metal slats fixed at regular intervals in said panel unit, with spacing between the louvers and between the rows of louvers that allow air flow through said panel unit.

11. The ballistic barrier assembly of claim 10, wherein the rows of louvers comprises a first row of outwardly facing louvers positioned to engage a ballistic threat and a second row of inwardly facing louvers spaced apart from the first row.

12. The ballistic barrier assembly of claim 11, wherein said first row of louvers presents an angled downwardly facing surface to any entering projectile.

13. The ballistic barrier assembly of claim 11, wherein said first and second rows of louvers generally form a "V"-shape when seen in cross-section, but with the lowermost edges of a louver on the first row being spaced apart from an adjacent louver on the first row and an adjacent louver on the second row of louvers.

14. A modular ballistic barrier assembly for deployment in proximity to a protected asset, comprising:

a plurality of prefabricated ballistic barrier panel units that can be stacked on top of each other to form a stack of said panel units, each of said panel units comprising a plurality of spaced apart angled steel louvers or slats, arranged in one or more sections, supported by a pair of side supporting plates;

a plurality of vertical support columns provided at spaced apart intervals to receive and support said stack of said panel units;

each of said panel units configured to interlock with a vertically adjacent, stacked lower panel unit, with a lowermost extent of a front-facing, bottommost louver of said panel unit extending downwardly beyond a bottommost extent of said pair of side supporting plates of said panel unit, such that a portion of the bottommost louver of said panel unit extends into a space of said lower panel unit to provide overlap with a rearward facing louver on an inner side of said lower panel unit;

an angled notch provided at a topmost extent of said side supporting plates in said lower panel unit, to receive a downwardly extending portion of the bottommost louver of said panel unit that is stacked atop of said lower panel unit, whereby multiple panel units can be stacked but provide a full width louver at the bottommost extent of each of said panel units positioned above a lower panel unit.

15. The ballistic barrier assembly of claim 14, wherein said support columns are mounted to pre-existing concrete footings, each of said support columns including upwardly extending threaded studs or bolts that extend through openings in a base plate that is welded to a bottom end of each said support column.

16. The ballistic barrier assembly of claim 15, wherein each of said support columns is a steel I-beam vertically mounted to one of said concrete footings.

17. The ballistic barrier assembly of claim 15, wherein said support columns include pre-cut slots in a flange of an I-beam to allow one of said panel units to be introduced and engaged horizontally into a pair of slots on a pair of spaced apart I-beams, and allowed to slide between said flanges downwardly into a resting position, captured between said flanges.

18. The ballistic barrier assembly of claim 17, wherein each pair of said support columns contains a three unit stack of said panel units, the slot on each I-beam preferably extending approximately ⅓ of the length of said support column, so that at least two of said panel units can be stacked and captured within said flanges of said support columns.

19. The ballistic barrier assembly of claim 18, wherein a cover plate is affixed to each of the said support columns to retain the panel unit at the top of said stack of said panel units.

20. The ballistic barrier assembly of claim 19, wherein said slots in said support columns are of a size about the same as a height of one of said panel units, and wherein a portion of each of said support columns provides a surface for mounting said cover plate to retain a topmost panel of a stacked group of said panel units.

21. The ballistic barrier assembly of claim 20, wherein said support columns include a plurality of openings for receiving fastening bolts that support the cover plates that covers the slots and retain and hold said panel unit in position stacked atop one or more of said panel units.

* * * * *